US005277492A

United States Patent [19]

Paul

[11] Patent Number: 5,277,492

[45] Date of Patent: Jan. 11, 1994

[54] BLENDER WITH INTERNAL MIXING CONE HAVING AN EXTENSION THEREON

[75] Inventor: Kermit D. Paul, Bethlehem, Pa.

[73] Assignee: Fuller-Kovako Corporation, Bethlehem, Pa.

[21] Appl. No.: 880,820

[22] Filed: May 8, 1992

[51] Int. Cl.[5] ..... B01F 13/02

[52] U.S. Cl. ..... 366/101; 366/341; 222/195; 222/564; 406/122; 406/163

[58] Field of Search ..... 366/3, 9, 10, 101, 106, 366/107, 136, 137, 154, 159, 191, 341; 414/288, 293; 406/134, 136, 122, 163; 222/195, 459, 464, 547, 564

[56] References Cited

U.S. PATENT DOCUMENTS

| | | | |
|---|---|---|---|
| 2,884,230 | 4/1959 | Pyle et al. | 222/195 X |
| 3,138,369 | 6/1964 | Bennett et al. | 366/136 |
| 3,871,626 | 3/1975 | Wohlfarth | 366/107 |
| 4,286,883 | 9/1981 | Johanson | 366/141 X |
| 4,412,748 | 11/1983 | Wohnhas et al. | 366/101 X |
| 4,478,517 | 10/1984 | Hoppe et al. | 366/101 |
| 4,548,342 | 10/1985 | Fisher | 222/564 X |
| 4,834,544 | 5/1989 | Paul | 366/101 |
| 4,923,304 | 5/1990 | Jackson et al. | 222/459 X |
| 4,978,227 | 12/1990 | Paul | 366/137 X |

FOREIGN PATENT DOCUMENTS

| | | | |
|---|---|---|---|
| 2001831 | 5/1990 | Canada | 366/101 |
| 2028414 | 10/1970 | France | 366/101 |
| 63-317490 | 12/1988 | Japan | 222/564 |
| 8006343 | 6/1981 | Netherlands | 222/564 |
| 2136407 | 9/1984 | United Kingdom | 222/564 |

*Primary Examiner*—Harvey C. Hornsby
*Assistant Examiner*—Charles Cooley
*Attorney, Agent, or Firm*—Daniel De Joseph

[57] ABSTRACT

An improved solid particulate matter blender which is essentially a cylindrical vessel with a hopper bottom and a central lift pipe through which pressurized gas is pumped in order to lift material from the bottom to the top for remixing. An internal cone structure mounted inside the conical bottom hopper improves the mixing action within the blender. A cylindrical extension is attached to the bottom of the internal cone structure and extends toward the bottom of the vessel. Material originating at various heights thus reaches the bottom and is lifted to the top together to accomplish the mixing action.

6 Claims, 2 Drawing Sheets

BLENDER WITH INTERNAL MIXING CONE HAVING AN EXTENSION THEREON

BACKGROUND OF THE INVENTION

This invention deals generally with a blender for solid particulate matter, and more specifically with a blender of the type which is a cylindrical vessel with a central lift column or pipe through which a gas is pumped to move material from the bottom to the top of the vessel for mixing.

Particulate blenders which are cylindrical vessels with central lift columns to raise bottom material to the top for mixing are well known in the art. They are available in versions which feed the new material into the vessel at either the bottom or the top of the vessel, and both types use a gas pumped up through the central pipe to lift material from the bottom to the top. The simplest such apparatus performs only the lifting action and therefore depends for the mixing action on imperfect mass flow of solids recirculating within the blender. Perfect mass flow within the blender would result in no blending since by definition no variation of downward velocity exists across horizontal planes in the blender tank. This basic flow concept has been traditionally adhered to in order that no dead (stagnant) spots exist in the blender which otherwise can seriously degrade performance. Thus the designer must adhere to the mass flow principal to avoid dead zones but then add devices which systematically withdraw materials from several elevations to produce mixing.

Considerably more complex apparatus has also been developed to enhance the blending action. Much of this depends upon the addition to the vessel of devices called "downcomers", which are separate columns or pipes which rise from the bottom of the vessel to various heights within the vessel, and thereby transport material directly from several different levels within the vessel to the bottom by gravity, from which the material is lifted to the top of the vessel again along with material which has progressed downward with the bulk of the material in the vessel.

While the downcomer system performs the blending function in a reasonably satisfactory manner, it requires a complex and expensive structure. In order to take material from several levels within the vessel and mix them together, there must be many columns of various heights spread throughout the vessel, or there must be multiple columns with controlled openings throughout their lengths. Moreover, each such column or pipe requires a strong support structure, since it is subjected to the movement and stresses of the stored material.

SUMMARY OF THE INVENTION

The present invention eliminates the complexity of the downcomer system, and substitutes a single simple structure which is located near the bottom of the vessel, is easy to support and accommodates to all types of materials. Moreover, the present invention performs the blending function in an exemplary manner, and is usable in vessels which have their material fed in at either the top or bottom.

The present invention adds a simple cone structure within the vessel. This inner cone is located near the junction of the cylindrical section of the vessel, and preferably just above the outer hopper section of the vessel which is attached to the bottom of the cylindrical section. The inner cone can be attached to the inner walls of the vessel, such as at the inner cone's top edge. In order to permit material to flow downward past the upper edge of the inner cone, either simple structural struts are used to leave some space between the inner cone's upper edge and the vessel walls, or the inner cone's upper edge is itself attached to the vessel walls and holes are formed in the inner cone near the vessel walls. Alternatively, the inner cone's upper edge can be spaced apart from the inner walls of the blender and there can be holes located on the surface of the inner cone through which some of the material will pass.

The lower edge of the inner cone is located near the lower edge of the outer cone of the vessel. In the typical blender of the type described here, there is an additional tubular extension of the vessel below the lower edge of the hopper section, and it is within this lower section that the central lift column terminates. This lower extension is a cylinder with a cross section in the horizontal plane smaller than the cross section of the main cylindrical section of the vessel, and it is called the "seal leg", because it is sized to force most of the gas pumped from below it to flow up the central lift pipe. The lower extension is also sized to prevent the gas from fluidizing the material around the lift pipe. If the material were fluidized, it would not flow downward easily. Of course, without downward flow, the recycle process within the blender would not continue.

The lower edge of the inner cone can terminate near the lift pipe just above the junction of the seal leg with the lower edge of the hopper section of the vessel. The material flowing from above and below this inner cone must travel downward to reach the input of the lift pipe, the input being located below the lower edge of the inner cone.

A function of the present invention is to reduce the velocity of the downward travel of part of the material in the vessel so that some of the material starting from the uppermost layers of the material in the vessel will reach the input of the lift tube before the rest of the material with which it once shared the uppermost layers, and will therefore be mixed with material originating from other layers at different heights.

Not only does the inner cone perform this function, but since, unlike the specifically located discrete downcomers, the inner cone can provide a continuous range of velocity differences across the cross section of the vessel if there is a continuous slot between the outer wall of the inner cone and the inner wall of the blender at the upper perimeter of the inner cone. Alternatively, if a few, e.g., only two or three, holes in the inner cone are used to withdraw material from the main bed of material within the blender a broad range of velocity variations can be created to provide a random and thorough mixing action.

In effect, the comparatively small central opening of the inner cone feeds material into the upper end of the seal leg and the annulus between the inner cone outlet and the seal leg is fed by material flowing from the main bed via the space between the inner cone and tank hopper. The downward velocity at the upper end of the seal leg is the same for both flow streams entering the seal leg. The actual velocity through the blender is dependant upon the pumping rate of the lift pipe and the horizontal cross sectional area of the seal leg. In both material flow paths, the material velocity at the upper edge of the inner cone is equal to the seal leg velocity times the respective ratios of area for each flow path in the seal leg divided by the flow area for each flow path located at the upper end of the inner cone. This variation in downward velocity at the upper end of the inner cone yields a wide range of downward velocities and a very desirable mixing action. If area A3 represents the cross-sectional area through the horizontal plane in the seal leg lying between the outer wall at the bottom of the inner cone and the inner wall of the seal leg, and A4 represents the cross-sectional area between the outer wall of the lift pipe and the inner wall of the seal leg then, in the preferred embodiment of this invention $0.1 \leqq A3/A4 \leqq 0.9$ and, more preferably, A3/A4 ranges from about 0.4 to about 0.6.

The result is that the present invention furnishes a superior blender for particulate materials, and does so with a simple and inexpensive structure.

DETAILED DESCRIPTION OF THE INVENTION

Figure 1:
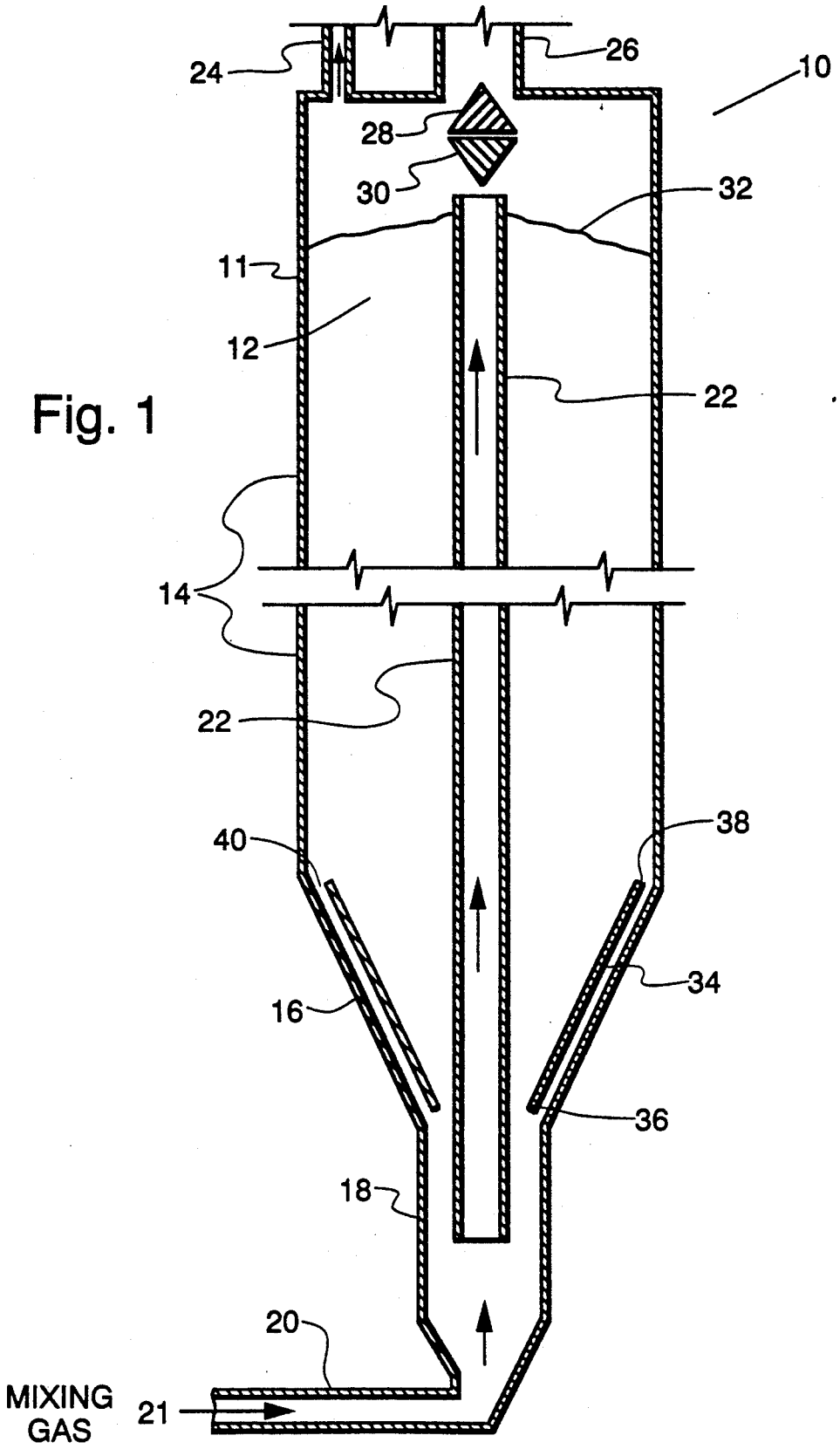
FIG. 1 is a vertical cross section view of one embodiment of the invention.

FIG. 1 is a vertical cross section view of one embodiment of the invention in which blender 10 is shown with a discontinuity in its height and is filled to approximately its maximum level with particulate matter 12.

As with most conventional blenders, blender 10 is constructed essentially as a vertical vessel or tower 11, with a cylindrical upper section 14, and hopper section 16 attached to upper section 14 at its lowest point. Attached to and extending down from hopper 16 is seal leg 18, which is also a cylinder. Gas supply pipe 20 is attached to seal leg 18 at or near the lower end of seal leg 18. Gas pipe 20 supplies mixing gas 21 to blender 10 from a pressurized gas source (not shown). The general direction of flow of mixing gas 21 is shown by the arrows, and conventional gas vent 24 may be located high up in vessel 11 to permit the gas to escape.

Lift column or lift pipe 22 is centrally located within blender 10, extends from a location within seal leg 18 to the uppermost region of upper section 14, and may be held fixed in place such as by conventional web type support brackets (not shown) which extend out from the walls of blender 10.

Material fill pipe 26 supplies new particulate material to blender 10 for addition to and mixing with particulate material 12 already within vessel 11. As is well understood in the art, material could also be supplied at the bottom of vessel 11 by mixing it with gas 21 entering at that location.

Deflectors 28 and 30 are located near the ends of fill pipe 26 and lift pipe 22, respectively. Deflector 28 spreads out the material entering vessel 11 so that the upper surface 32 of material 12 is more level, and it prevents particulate material entering vessel 11 from interacting with lift pipe 22 or the material traveling up lift pipe 22. Similarly, deflector 30 spreads out the material exiting lift pipe 22 and isolates it from the effects of the new material entering vessel 11.

All of the components and actions described above are quite conventional, and are already used and well understood in the art of particulate material blenders.

It is inner cone 34, located within the lower portion of vessel 11, which is the basis of the present invention. Inner cone 34 is located so that the edge of its lower opening 36 is near the junction of hopper section 16 and seal leg 18, and so that the edge of its upper opening 38 is near the junction of hopper section 16 and upper cylindrical section 14. Inner cone 34 is also constructed so that lift pipe 22 passes through its lower opening 36 with generous clearance, so that material will flow freely through opening 36 and around lift pipe 22.

Since the purpose of inner cone 34 is to permit material to flow between it and the inner walls of vessel 11, inner cone 34 must be located a sufficient distance from the vessel walls to permit free flow of material along its outside surface between it and the walls of vessel 11. Moreover, there must exist at the upper edge 38 of inner cone 34, at least some space 40 or a similarly located hole in the surface of inner cone 34 to permit the material to enter the space between inner cone 34 and the walls of vessel 11.

With these criteria for the location and structure of inner cone 34 fulfilled, there is a resultant wide range of downward velocities within the blender, which causes the material within the vessel to be thoroughly mixed by the action of mixing gas 21 constantly lifting material from within seal leg 18 to the top surface 32 of material 12.

Typically, when particles of material start from top surface 32 at the same time, the outermost particles will reach seal pipe 18 and the bottom of lift pipe 22 sooner than will the particles near the center of the vessel.

It is this difference in descent which is the basis of the mixing action, since the particles being transported up lift pipe 22 by gas 21 at any particular time are always a mixture of particles which were not previously at the same level of the material.

Figure 2:
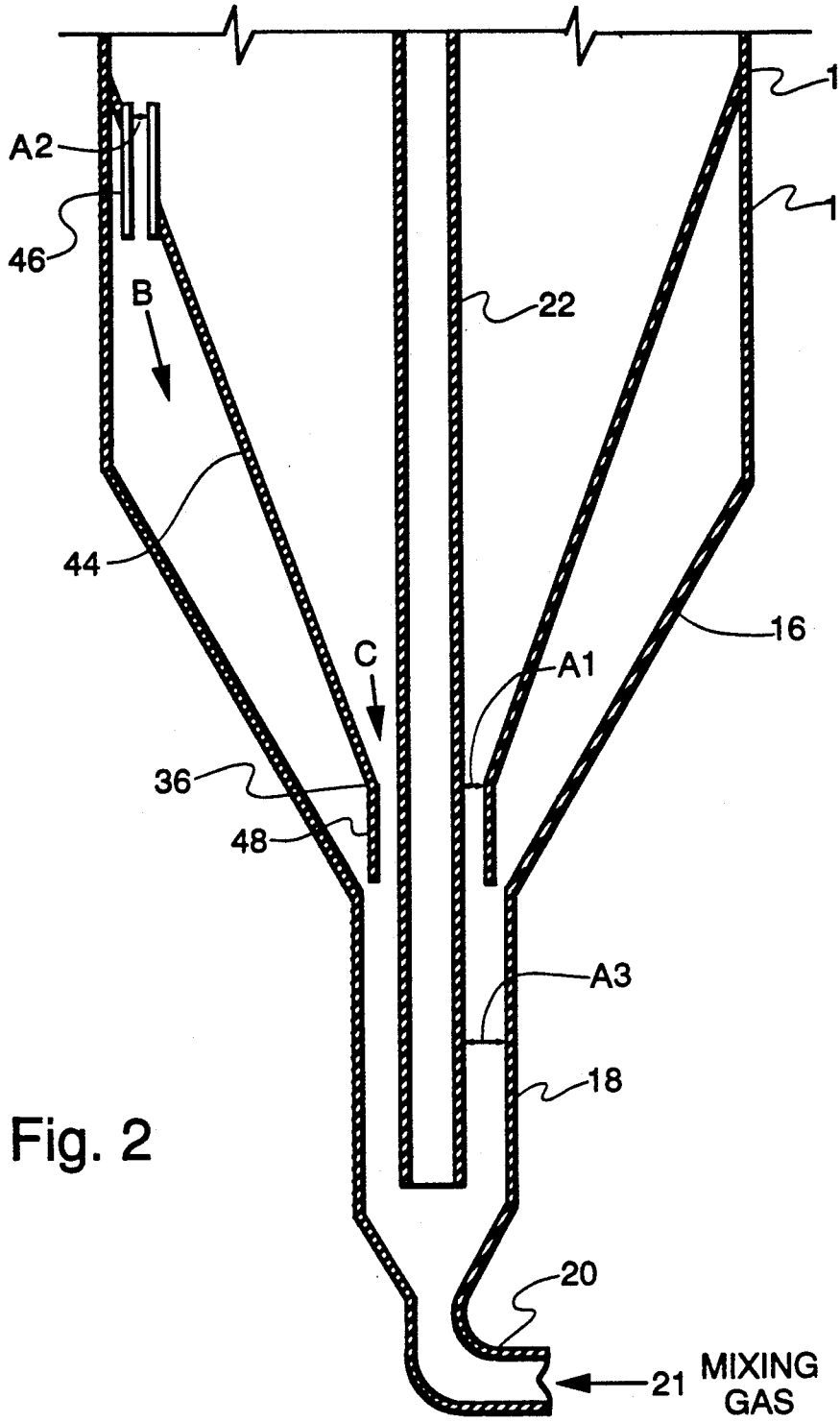
FIG. 2 is a vertical cross section view of the lower region of a second embodiment of the invention.

FIG. 2 shows only the lower portion of a second embodiment of the invention in which only the features of inner cone 44 are different from those shown in FIG. 1. The structure of vessel 11, upper section 14, hopper section 16, seal leg 18, lift pipe 22 and gas supply pipe 20 are the same as in FIG. 1, and all these parts are therefore identified by the same numerals as in FIG. 1. Area A1 represents the cross sectional area where extension 48 is joined to the lower edge of inner cone 44.

Essentially, inner cone 44 of FIG. 2 differs from inner cone 34 of FIG. 1 only in that inner cone 44 has, at least one, and preferably two or more, through pipes 46 located in it adjacent to the inner wall of vessel 11, and in that it includes extension 48 at it lower edge. The length of extension 48 is represented by the sum of L1, which represents the length of the extension from its upper end 50 to point 51 which is the location adjacent to the junction point of hopper 16 to seal leg 18, and L3, which represents the length of the extension from point 51 to its bottommost point 52.

Through pipe 46 of length L2 is merely a variation of the spacing shown between the vessel wall and the top edge of the inner cone in FIG. 1. Both structures act in the same manner to permit material to flow freely downward into the space between the outer surface of the inner cone and the inner surface of the vessel. However, the use of through pipe 46 or a plurality of discrete holes (preferably equally spacing) are actually the preferred structure because individual pipes or holes are more predictable in their action than the larger cross section area which results from a space adjacent to the large inner circumference of a typical industrial blender.

Extension 48, however, performs an additional function not accounted for in the previous embodiment, and it acts to dramatically improve the function of the inner cone.

Without the addition of extension 48, even with fixed dimensions, virtually every material has a different ratio for the flow C through the inside of inner cone 44 relative to the flow B outside inner cone 44. However, with the addition of an extension 48 having an L1 of approximately the same length as lengths L2 of pipes 46, and the adjustment of the dimensions of the openings so that the flow ratios B/A and C/A for all materials will remain essentially the same and can be controlled by the ratios of A3/A4 and A2/A4, respectively. Preferably, the sum of the cross section areas A2 of pipes 46 is approximately equal or greater than the cross section of the material flow area A3 within seal leg 18.

Such a structure therefore permits knowledgeable prediction of the mixing times required for all materials, and assures that all materials can be satisfactorily and thoroughly mixed.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, the claimed invention can be used with blenders with either top or bottom feed, and the external shape of the blender is not critical to the success of the invention.

What is claimed as new and for which Letters patent of the United States are desired to be secured is:

1. In a particulate material blender of the type which includes a vertically oriented vessel with a top and a bottom and with an inner wall and an outer wall, the vessel being constructed with an upper section which includes the top of the vessel, a hopper section attached to the vessel below the upper section and extending toward the bottom of the vessel, a seal leg attached to the hopper section at a junction at the bottom of the hopper section with the seal leg extending toward the bottom of the vessel, a source of pressurized gas attached to the vessel at a gas entry near the bottom of the seal leg, and a lift pipe supported within the vessel and extending from a location near the top of the vessel to a location within the seal leg above the gas entry, the improvement comprising:

an inner cone structure with a smaller opening and a larger opening, the inner cone supported within the vessel and located so that the smaller opening is nearer to the vessel bottom than the larger opening; the lift pipe passes through both the smaller and larger openings; the smaller opening is located near the junction of the seal leg and the hopper section; and the outer surface of the inner cone is spaced away from the inner surface of the hopper section of the vessel by a distance sufficient to permit some material within the vessel to flow between the inner cone and the inner wall of the vessel; and a cylindrical extension attached to the inner cone at the smaller opening and extending toward the bottom of the vessel, with the bottom of the cylindrical extension located near the junction of the hopper section with the seal leg and the cylindrical extension having an outside diameter less than the inside diameter of the seal leg.

2. The blender of claim 1 wherein the inner cone contains at least one through hole in its surface through which material within the vessel can flow, said through hole being located adjacent to the inner wall of the vessel.

3. The blender of claim 1 wherein a portion of the cylindrical extension extends into the area between the outside of the lift pipe and the inside of the seal leg.

4. In a particulate material blender of the type which includes a vertically oriented vessel with a top and a bottom and with an inner wall and an outer wall, the vessel being constructed with an upper section which includes the top of the vessel, a hopper section attached to the vessel below the upper section and extending toward the bottom of the vessel, a seal leg attached to the hopper section at a junction at the bottom of the hopper section with the seal leg extending toward the bottom of the vessel, a source of pressurized gas attached to the vessel at a gas entry near the bottom of the seal leg, and a lift pipe supported within the vessel and extending from a location near the top of the vessel to a location within the seal leg above the gas entry, the improvement comprising:

an inner cone structure with a first smaller opening and a second larger opening, the inner cone supported within the vessel and located so that the first smaller opening is nearer to the vessel bottom than the second larger opening; the lift pipe passes through both the first smaller and second larger openings; the edge of the second larger opening is in contact with the inner wall of the vessel; and the outer surface of the inner cone other than the part of the outer surface near the edge of the second larger opening is spaced away from the inner surface of the hopper section of the vessel by a distance sufficient to permit some material within the vessel to flow between the inner cone and the inner wall of the vessel;

with the inner cone containing at least one through hole in its surface through which material within the vessel can flow; and a cylindrical extension attached to the bottom of the inner cone with the bottom of the cylindrical extension located near the junction of the hopper section with the seal leg and the cylindrical extension having an outside diameter less than the inside diameter of the seal leg.

5. The blender of claim 4 wherein the through hole in the inner cone has a cylinder penetrating it.

6. The blender of claim 4 wherein a portion of the cylindrical extension extends into the area between the outside of the lift pipe and the inside of the seal leg.

* * * * *